US006591994B1

(12) United States Patent
Bearss

(10) Patent No.: US 6,591,994 B1
(45) Date of Patent: Jul. 15, 2003

(54) HOCKEY EQUIPMENT RACK

(76) Inventor: Ronald S. Bearss, 284 Hillcrest, Harrison, MI (US) 48625

( * ) Notice: Subject to any disclaimer, the term of this patent is extended or adjusted under 35 U.S.C. 154(b) by 0 days.

(21) Appl. No.: 10/123,991

(22) Filed: Apr. 16, 2002

(51) Int. Cl.[7] ..... A47F 7/00

(52) U.S. Cl. ..... 211/85.7; 211/189; D6/552; 248/174

(58) Field of Search ..... 211/85.9, 189, 211/85.2, 85.3; D6/552; 248/174

(56) References Cited

U.S. PATENT DOCUMENTS

| | | | | | |
|---|---|---|---|---|---|
| 4,846,353 | A | * | 7/1989 | Knight et al. | 211/189 X |
| 5,335,753 | A | * | 8/1994 | Campbell | 248/174 X |
| 5,372,342 | A | * | 12/1994 | Adams | 248/174 |
| D354,654 | S | * | 1/1995 | Mallen | D6/552 |
| 5,377,849 | A | * | 1/1995 | Martin | 211/189 X |
| D394,926 | S | * | 6/1998 | Lindsay | D6/552 X |
| D398,469 | S | * | 9/1998 | Leong et al. | D6/552 |
| 5,862,924 | A | * | 1/1999 | Dumont | 211/85.7 |
| 6,116,553 | A | * | 9/2000 | McKee | 248/174 |
| 6,164,465 | A | * | 12/2000 | Schroeder | 211/85.7 |
| 6,216,887 | B1 | * | 4/2001 | Soo | 211/85.7 |

OTHER PUBLICATIONS

Ocean Hockey Supply Co Catalog p. 18 date unknown.
Mr. Gear, Web Page of Mar. 20, 2002 (inventor's web page).

* cited by examiner

*Primary Examiner*—Robert W. Gibson, Jr.
(74) *Attorney, Agent, or Firm*—Timothy S. Stevens

(57) ABSTRACT

A hockey equipment rack composed of intersecting panels. The panels are easily dismounted for storage. Apertures and/or cutouts in the panel(s) are provided for positioning hockey equipment.

13 Claims, 2 Drawing Sheets

HOCKEY EQUIPMENT RACK

BACKGROUND

Hockey equipment (such as gloves, helmet, shoulder pads, skates, socks, knee pads, shirt and pants) tends to become wet during a hockey game. After such a game it is common practice to hang such equipment on a hockey equipment rack to dry. Hockey equipment racks that are similar to an ordinary coat rack are commercially available. Improved hockey equipment racks have also been invented, see U.S. Pat. No. 5,377,849 issued to Harold G. Martin on Jan. 3, 1995.

Hockey games are often played away from home. Hockey players may stay overnight in hotel or motel rooms after a hockey game. In such circumstances, it would be beneficial to have a portable, compact and easily dismountable hockey equipment rack rather than placing wet equipment over the chairs, tables, cabinets and beds of a hotel or motel room. However, as a general rule the prior art hockey equipment racks tend not to be compact and easily dismountable.

It would be an advance in the art if a hockey equipment rack were invented that was compact in storage (especially for storage in a vehicle) but easily assembled for use, for example, in a motel or hotel room.

SUMMARY OF THE INVENTION

A primary benefit of the instant invention is that it is a hockey equipment rack that is compact in storage (especially for storage in a vehicle) but which is easily assembled for use, for example, in a motel or hotel room. The instant invention is a hockey equipment rack composed of at least two intersecting panels. The panels are easily dismounted for storage. Apertures, protrusions and/or cutouts in the panel(s) are provided for positioning hockey equipment.

More specifically, the instant invention is a hockey equipment rack, comprising: (a) a first panel, the first panel having a top and a bottom, the first panel defining an upwardly projecting cutout therein from the bottom toward the top, the first panel defining an aperture therein so that hockey equipment can be positioned in the aperture; and (b) a second panel, the second panel having a top and a bottom, the second panel defining a downwardly projecting cut-out therein from the top toward the bottom, the downwardly projecting cut-out intersecting with the upwardly projecting cutout of the first panel so that the first panel and the second panel form a free standing hockey equipment rack.

In another embodiment, the instant invention is a hockey equipment rack, comprising: (a) a first panel, the first panel having a top and a bottom, the first panel defining an upwardly projecting cutout therein from the bottom toward the top, the top of the first panel being formed to have an upwardly projecting portion so that a hockey helmet can be mounted on the upwardly projecting portion of the top of the first panel; and (b) a second panel, the second panel having a top and a bottom, the second panel defining a downwardly projecting cut-out therein from the top toward the bottom, the downwardly projecting cut-out intersecting with the upwardly projecting cutout of the first panel so that the first panel and the second panel form a free standing hockey equipment rack.

In yet another embodiment, the instant invention is a hockey equipment rack, comprising: (a) a first panel, the first panel having a top, a bottom and sides, the first panel defining an upwardly projecting cutout therein from the bottom toward the top, the top of the first panel being formed to have an upwardly projecting portion so that a hockey helmet can be mounted on the upwardly projecting portion of the top of the first panel, the first panel defining a sideward projecting cutout therein from one side toward the other side so that hockey equipment can be positioned on the first panel; and (b) a second panel, the second panel having a top and a bottom, the second panel defining a downwardly projecting cut-out therein from the top toward the bottom, the downwardly projecting cut-out intersecting with the upwardly projecting cutout of the first panel so that the first panel and the second panel form a free standing hockey equipment rack.

DETAILED DESCRIPTION OF THE INVENTION

Figure 1:
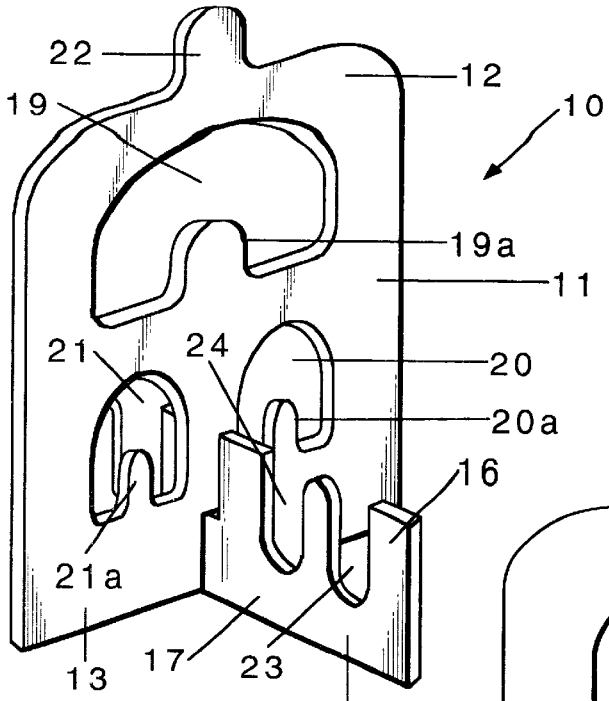
FIG. 1 is a side perspective view of a hockey equipment rack of the instant invention that includes a first and a second panel that intersect with each other.

Referring now to FIG. 1 therein is shown a side perspective view of a hockey equipment rack 10 of the instant invention. The rack 10 is comprised of a first panel 11 (shown in side view in FIG. 2). The first panel 11 has a top portion 12 and a bottom portion 13. The first panel 11 also defines an upwardly projecting cutout 14 therein from the bottom portion 13 toward the top portion 12.

Figure 2:
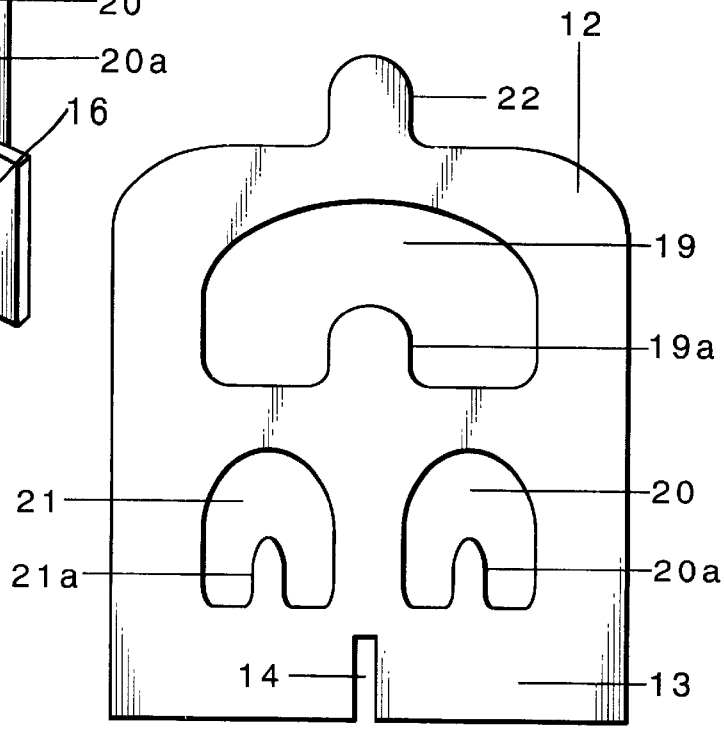
FIG. 2 is a side view of the first panel of the hockey equipment rack of FIG. 1.
Figure 3:
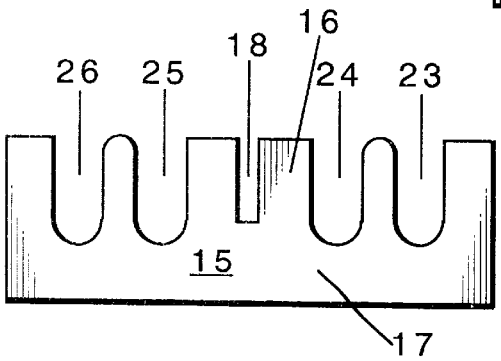
FIG. 3 is a side view of the second panel of the hockey equipment rack of FIG. 1.

Referring still to FIG. 1, the rack 10 also comprises a second panel 15 (shown in side view in FIG. 3). The second panel 15 has a top portion 16 and a bottom portion 17. The second panel 15 also defines a downwardly projecting cutout 18. Referring now to FIGS. 1–3, the cutout 14 in the first panel 11 and the cutout 18 in the second panel 15 intersect with each other so that the first panel 11 and the second panel 15 form the free standing hockey equipment rack 10 of FIG. 1.

Referring still to FIGS. 1 and 2, apertures 19, 20 and 21 are provided so that hockey equipment can be positioned therein. For example, skates can be positioned upside down over the upwardly projecting lower portion 21*a* and 20*a* of the apertures 21 and 20 while pants can be positioned over the upwardly projecting lower portion 19*a* of the aperture 19. The top portion 12 of the first panel 11 is formed to have an upwardly projecting portion 22 so that a hockey helmet can be mounted thereon. The upper corners of the first panel 11 are rounded to better accommodate shoulder pads.

Referring now to FIGS. 1 and 3, the second panel 15 defines a plurality of downwardly projecting cutouts 23, 24, 25 and 26 to provide undulating surfaces on the second panel for other equipment such as gloves or mitts.

Referring now to FIGS. 1–3, the first panel 11 is about 46 inches tall, about 24 inches wide cut from a ⅜-inch thick sheet of polyethylene (and preferably a length of ⅜×⅜×⅜-inch aluminum channel, not shown, is attached to each side of the first panel 11 to reinforce the first panel 11). The second panel 15 is about 14 inches tall, about 24 inches wide cut from a ⅜-inch thick sheet of polyethylene. However, it should be understood that these dimensions and materials although preferred are not, of course, critical in the instant invention. Similarly, the number and shape of apertures and/or projections in the first panel are not critical in the instant invention even though those shown are preferred.

Preferably, a single second panel 15 is used and the cutouts 14 and 18 are vertical and centered. However, it should be understood that the cutouts 14 and 18 could be canted and off center and that more than two panels can be used. For example, two spaced apart second panels can be used in the instant invention.

Figure 4:
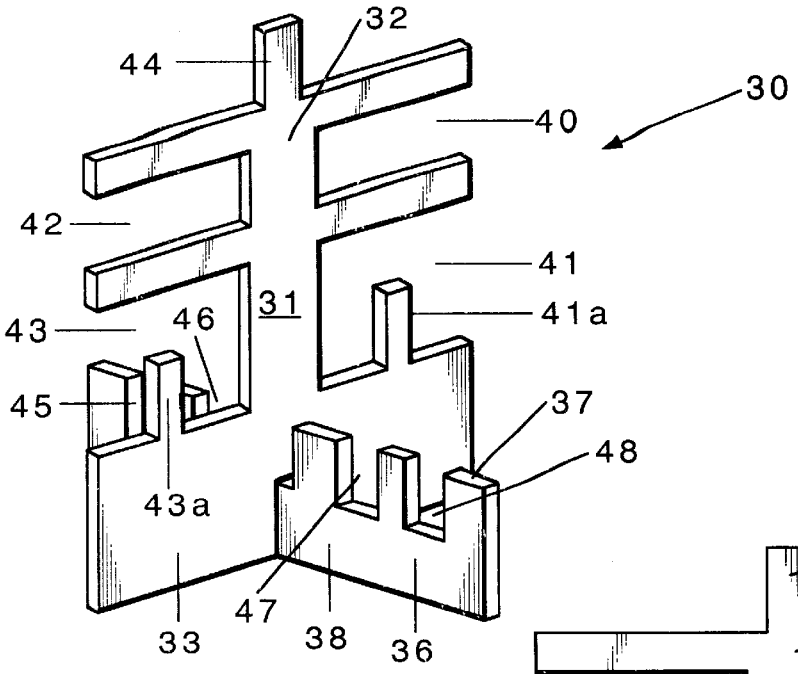
FIG. 4 is a side perspective view of another hockey equipment rack of the instant invention that includes a first and a second panel that intersect with each other.

Referring now to FIG. 4 therein is shown a side perspective view of another hockey equipment rack 30 of the instant invention. The rack 30 is comprised of a first panel 31 (shown in side view in FIG. 5). The first panel 31 has a top portion 32 and a bottom portion 33 and a side portion 34. The first panel 31 also defines an upwardly projecting cutout 35 therein from the bottom portion 33 toward the top portion 32.

Figure 5:
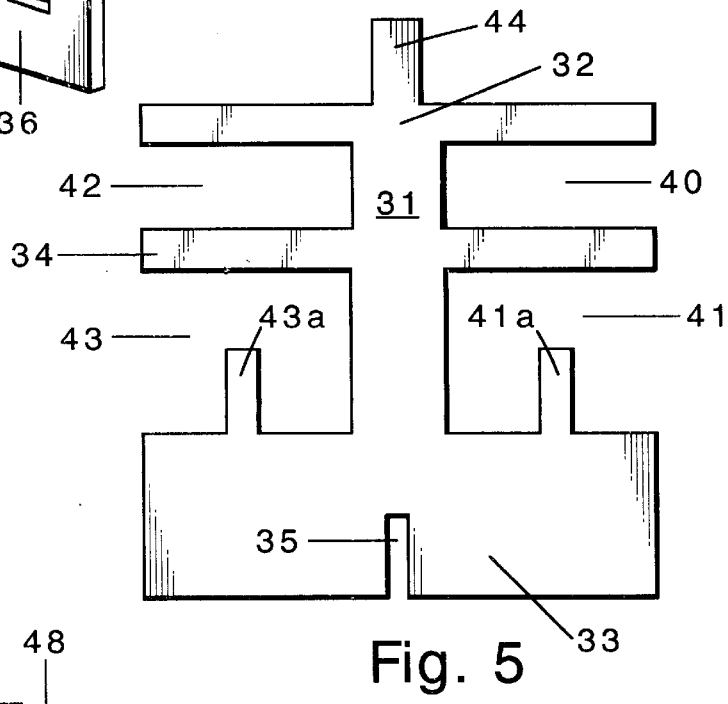
FIG. 5 is a side view of the first panel of the hockey equipment rack of FIG. 4.
Figure 6:
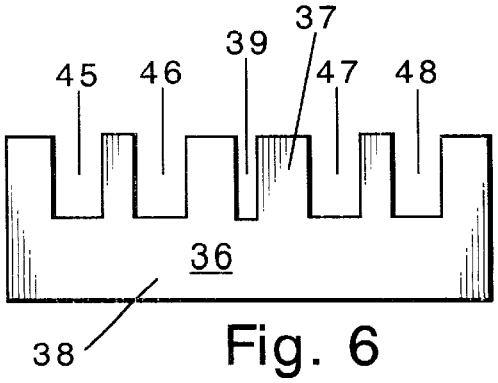
FIG. 6 is a side view of the second panel of the hockey equipment rack of FIG. 4.

Referring still to FIG. 4, the rack 30 also comprises a second panel 36 (shown in side view in FIG. 3). The second panel 15 has a top portion 37 and a bottom portion 38. The second panel 36 also defines a downwardly projecting cutout 39. Referring now to FIGS. 4–6, the cutout 35 in the first panel 31 and the cutout 39 in the second panel 35 intersect with each other so that the first panel 31 and the second panel 36 form the free standing hockey equipment rack 10 of FIG. 4.

Referring still to FIGS. 4 and 5, cutouts 40, 41, 42 and 43 are provided so that hockey equipment can be positioned therein and on the remaining portion of the panel 31. For example, skates can be positioned upside down over the upwardly projecting lower portion 41*a* and 43*a* of the cutout 41 and 43. The top portion 32 of the first panel 31 is formed to have an projecting portion 44 so that a hockey helmet can be mounted thereon.

Referring now to FIGS. 4 and 6, the second panel 36 defines a plurality of downwardly projecting cutouts 45, 46, 47 and 48 to provide undulating surfaces on the second panel for other equipment such as gloves or mitts.

Referring now to FIGS. 4–6, the first panel 31 is about 46 inches tall, about 24 inches wide cut from a ⅜-inch thick sheet of polyethylene. The second panel 36 is about 14 inches tall, about 24 inches wide cut from a ⅜-inch thick sheet of polyethylene. However, it should be understood that these dimensions and materials although preferred are not, of course, critical in the instant invention. Similarly, the number and shape of projections in the panels are not critical in the instant invention even though those shown are preferred.

Preferably, a single second panel 36 is used and the cutouts 35 and 39 are vertical and centered. However, it should be understood that the cutouts 35 and 39 could be canted and off center and that more than two panels can be used. For example, two spaced apart second panels could be used.

Although FIGS. 1–6 show two preferred embodiments of the instant invention, it should be understood that many other embodiments are covered by the following claims.

What is claimed is:

1. A hockey equipment rack, comprising: (a) a first panel, the first panel having a top and a bottom, the first panel defining an upwardly projecting cutout therein from the bottom toward the top, the first panel defining an aperture therein so that hockey equipment can be positioned in the aperture; and (b) a second panel, the second panel having a top and a bottom, the second panel defining a downwardly projecting cut-out therein from the top toward the bottom, the downwardly projecting cut-out intersecting with the upwardly projecting cutout of the first panel so that the first panel and the second panel form a free standing hockey equipment rack wherein the top of the first panel is formed to have an upwardly projecting portion so that a hockey helmet can be mounted on the upwardly projecting portion of the top of the first panel, the upwardly projection portion being positioned in the middle of the top of the first panel.

2. The hockey equipment rack of claim 1, wherein a plurality of additional downwardly projecting cutouts are formed from the top toward the bottom of the second panel so that hockey equipment can be better positioned on the second panel.

3. The hockey equipment rack of claim 1, wherein a plurality of additional downwardly projecting cutouts are formed from the top toward the bottom of the second panel so that hockey equipment can be better positioned on the second panel.

4. The hockey equipment rack of claim 2, wherein the top of the first panel is formed to have an upwardly projecting portion so that a hockey helmet can be mounted on the upwardly projecting portion of the top of the first panel.

5. A hockey equipment rack, comprising: (a) a first panel, the first panel having a top and a bottom, the first panel defining an upwardly projecting cutout therein from the bottom toward the top, the top of the first panel being formed to have an upwardly projecting portion positioned in the middle of the top of the first panel so that a hockey helmet can be mounted on the upwardly projecting portion of the top of the first panel; and (b) a second panel, the second panel having a top and a bottom, the second panel defining a downwardly projecting cut-out therein from the top toward the bottom, the downwardly projecting cut-out intersecting with the upwardly projecting cutout of the first panel so that the first panel and the second panel form a free standing hockey equipment rack.

6. The hockey equipment rack of claim 5, wherein the first panel defines an aperture therein so that hockey equipment can be positioned in the aperture.

7. The hockey equipment rack of claim 5, wherein a plurality of additional downwardly projecting cutouts are formed from the top toward the bottom of the second panel so that hockey equipment can be positioned on the second panel.

8. The hockey equipment rack of claim 6, wherein a plurality of additional downwardly projecting cutouts are formed from the top toward the bottom of the second panel so that hockey equipment can be positioned on the second panel.

9. The hockey equipment rack of claim 7, wherein the first panel defines an aperture therein, the aperture so that hockey equipment can be hung through the aperture.

10. A hockey equipment rack, comprising:

(a) a first panel, the first panel having a top, a bottom and sides, the first panel defining an upwardly projecting cutout therein from the bottom toward the top, the top of the first panel being formed to have an upwardly projecting portion so that a hockey helmet can be mounted on the upwardly projecting portion of the top of the first panel, the first panel defining a sideward projecting cutout therein from one side toward the other side so that hockey equipment can be positioned on the first panel; and (b) a second panel, the second panel having a top and a bottom, the second panel defining a downwardly projecting cut-out therein from the top toward the bottom, the downwardly projecting cut-out intersecting with the upwardly projecting cutout of the first panel so that the first panel and the second panel form a free standing hockey equipment rack.

11. The hockey equipment rack of claim 10, wherein a plurality of additional downwardly projecting cutouts are formed from the top toward the bottom of the second panel so that hockey equipment can be positioned on the second panel.

12. A hockey equipment rack, comprising:

(a) a first panel, the first panel having a top, a bottom and sides, the first panel defining an upwardly projecting cutout therein from the bottom toward the top, the first panel defining a sideward projecting cutout therein from one side toward the other side so that hockey equipment can be positioned on the first panel; and (b) a second panel, the second panel having a top and a bottom, the second panel defining a downwardly projecting cut-out therein from the top toward the bottom, the downwardly projecting cut-out intersecting with the upwardly projecting cutout of the first panel so that the first panel and the second panel form a free standing hockey equipment rack.

13. The hockey equipment rack of claim 12, wherein a plurality of additional downwardly projecting cutouts are formed from the top toward the bottom of the second panel so that hockey equipment can be positioned on the second panel.

* * * * *